United States Patent [19]

Clemensen et al.

[11] 4,303,713

[45] Dec. 1, 1981

[54] ROOF INSULATION STRUCTURE AND METHOD OF MAKING SAME

[76] Inventors: Carl L. Clemensen, P.O. Box 12090, Wichita, Kans. 67277; Frank T. Mastalka, 4605 Holly St., Denver, Colo. 80216

[21] Appl. No.: 49,279

[22] Filed: Jun. 18, 1979

[51] Int. Cl.[3] ..... B32B 3/04

[52] U.S. Cl. ..... 428/121; 52/743; 52/404; 428/906

[58] Field of Search ..... 52/404, 407, 631, 326, 52/327, 478, 743; 29/DIG. 33; 206/321; 428/43, 121, 906; 229/87 R

[56] References Cited

U.S. PATENT DOCUMENTS

| | | | |
|---|---|---|---|
| 1,288,132 | 12/1918 | Nagle | 29/DIG. 33 |
| 1,894,592 | 1/1933 | Kilmer | 52/407 |
| 2,264,976 | 12/1941 | Heritage | 52/406 |
| 2,309,056 | 1/1943 | Finck | 52/407 |
| 2,756,463 | 7/1956 | Clements | 52/631 |
| 2,864,324 | 12/1958 | Clements | 52/478 |
| 3,513,614 | 5/1970 | Studzinski | 52/404 |
| 3,662,509 | 5/1972 | Studzinski | 52/404 |
| 3,958,385 | 5/1976 | Bondra et al. | 52/404 |
| 3,969,863 | 8/1974 | Alderman | 52/407 |
| 3,979,537 | 9/1976 | Troyer | 52/404 |
| 4,047,345 | 9/1977 | Alderman | 52/404 |
| 4,047,346 | 9/1977 | Alderman | 52/90 |
| 4,125,982 | 11/1978 | Ward | 52/743 |
| 4,147,003 | 4/1979 | Alderman | 52/404 |

FOREIGN PATENT DOCUMENTS

| | | | |
|---|---|---|---|
| 229210 | 12/1910 | Fed. Rep. of Germany | 52/404 |

*Primary Examiner*—James L. Ridgill, Jr.
*Attorney, Agent, or Firm*—Edwin H. Crabtree

[57] ABSTRACT

A roof insulation structure and method of making the structure for greatly improving the insulation quality of a metal building roof. The structure includes a self-supporting medium density thermal insulation blanket having elongated slits and notches in the top thereof so that the blanket can be folded into a "U" shaped configuration. The "U" shaped blanket is received on the top and the sides of a pair of adjacent and parallel roof purlins and spans the width therebetween. The "U" shaped configuration of the blanket provides means for receiving a thick blanket of low density thermal insulation inside thereof and between the purlins for increasing the insulation "R" factor of the insulated roof.

10 Claims, 10 Drawing Figures

ROOF INSULATION STRUCTURE AND METHOD OF MAKING SAME

BACKGROUND OF THE INVENTION

The invention relates to an improved roof insulation structure and method of making the structure and more particularly, but not by way of limitation, to a self-supporting medium density thermal insulation blanket adapted for receipt on top of and between parallel roof purlins. The blanket forms a "U" shaped configuration for receiving a blanket of thick low density thermal insulation therein.

Heretofore there have been various types of metal building roof systems and methods of applying insulation such as the invention disclosed in U.S. Pat. Nos. 4,047,345, 4,047,346, and 3,969,863 to Alderman and U.S. Pat. Nos. 3,513,614 and 3,662,509 to Studzinski. Also various types of grooving self-supporting insulation and methods of grooving the insulation are disclosed in U.S. Pat. No. 3,958,385 to Bondra and U.S. Pat. No. 4,117,641 to Wells. Additional roof insulation systems are disclosed in U.S. Pat. No. 3,979,537 to Troyer and U.S. Pat. No. 2,864,324 to Clements.

None of the patented inventions provide means for receiving and holding low density thick blankets of insulation on top of self-supporting medium density blankets constructed to be contoured around the structure of the metal roof purlins.

SUMMARY OF THE INVENTION

The subject invention provides structure and a method of making a roof insulation structure which can be quickly and efficiently mounted on top of and between metal roofed buildings for insulating on and around the metal purlins thereby reducing heat loss from around the purlins.

The roof insulation structure has "U" shaped configuration for receiving thick blankets of low density thermal insulation thereon so that additional space is provided between the roof purlins for increasing the amount of insulation in the building roof thereby increasing the insulation "R" factor.

The improved roof insulation structure now allows insulation contractors to increase the insulation "R" factor of metal building roofs thereby meeting recently adopted state and federal building insulation codes without having to modify the roof structure.

The "U" shaped self-supporting blanket, when installed, is self-aligning as it is folded and tucked adjacent and between the roof purlins. Also the depth of the "U" shaped configuration can be increased for receiving various thicknesses of the low density blankets between the purlins.

The roof insulation structure includes a blanket of self-supporting thermal insulation. The blanket has from end to end a "U" shaped configuration for receipt around and between a pair of adjacent and parallel roof purlins. The purlins have a vertical web with upper and lower horizontal flanges integrally attached to the top and bottom of the web. The blanket, when received on and between the purlins, is disposed on top of the upper horizontal flanges of the purlins and adjacent to the vertical web of the purlins. A center portion of the blanket spans the width between the purlins. When the blanket is folded and tucked adjacent the roof purlins the "U" shaped configuration of the blanket is used for receiving a blanket of low density thermal insulation inside thereof.

The advantages and objects of the invention will become evident from the following detailed description of the drawings when read in connection with the accompanying drawings which illustrate preferred embodiments of the invention.

DETAILED DESCRIPTION OF THE DRAWINGS

During the past few years in the United States the public has become more aware of a growing energy crisis and the rapid depletion of our fossil fuel reserves used in heating and cooling buildings and in internal combustion engines. State and federal government have reacted to this crisis by legislating stricter building codes requiring increased insulation in new building construction to lower power consumption in the heating and cooling of buildings.

In the building insulation industry an insulation "R" factor is used to indicate the thickness of insulation and its resistance to heat and cold loss to the outside atmosphere. The higher the "R" factor the greater the resistance to heat and cold transfer. In wall and roof insulation a one inch to one and one-half inch blanket of self-supporting medium density thermal insulation will have an "R" factor of 4. A three inch blanket has an "R" factor of 10, a six inch blanket "R" 19, and a ten inch blanket "R" 30.

A goal of the metal building industry, in order to meet proposed and new state and federal codes, is to provide metal building roofs with an "R" factor of between 15 and 50.

The inventors of the subject invention, being owners of successful metal building insulation companies, seek to meet and exceed the industry goal by using the following described roof insulation structure and method of making the structure to the betterment of the metal building industry and the American public.

Figure 1:
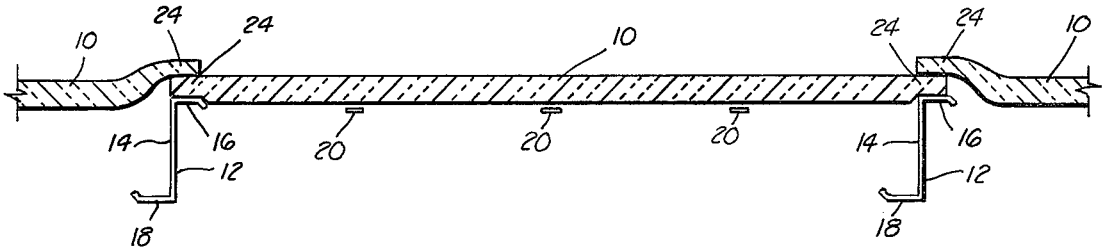
FIG. 1 PRIOR ART
FIG. 1 is a cross sectional end view of prior art construction using a self-supporting medium density insulation blanket spanning between two metal roof purlins with the ends of the blanket overlapping on top of the upper horizontal flanges of the purlin.

In FIG. 1 a cross sectional end view of prior art construction of insulating a metal building roof is illustrated. In this view a one and one-half to two inch thick self-supporting medium density thermal insulation blanket 10 is shown spanning the width between two metal roof purlins 12. In metal roof construction, the more popular "Zee" type purlin, such as purlins 12 are used. There are "C" shaped purlins which are used, but they are not as common as the "Zee" type purlin. The purlins 12 include a vertical web 14 integrally attached to an upper horizontal flange 16 and a lower horizontal flange 18. This type of purlin generally has the dimensions of two inch wide horizontal flanges 16 and 18 with the vertical web 12 in a range of eight to ten inches.

Figure 5:
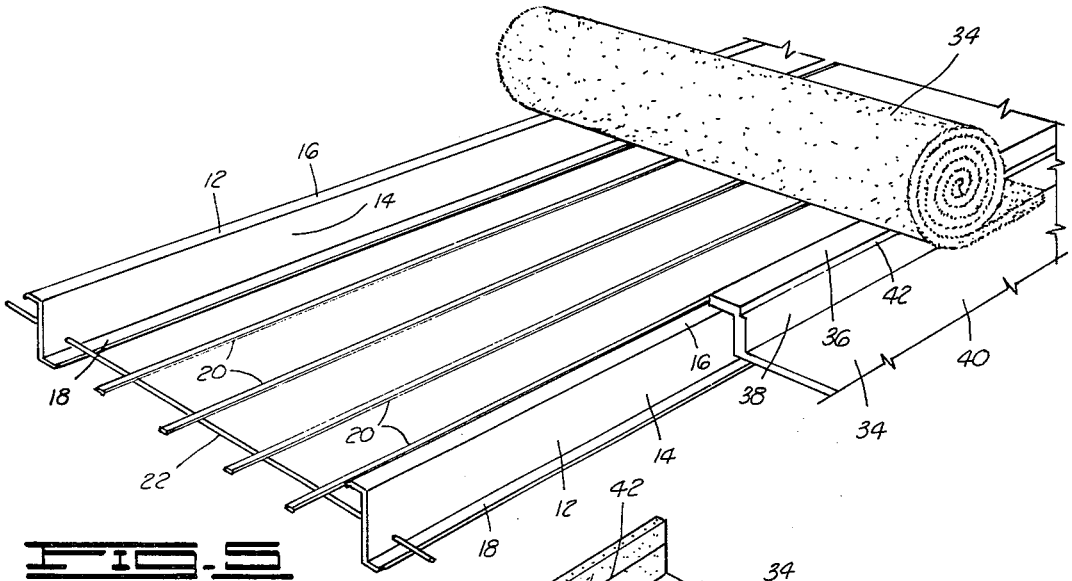
FIG. 5 is a perspective view of a typical metal roof building having a pair of parallel roof purlins with metal banding ready to receive a roll of the self-supporting blanket.
Figure 10:
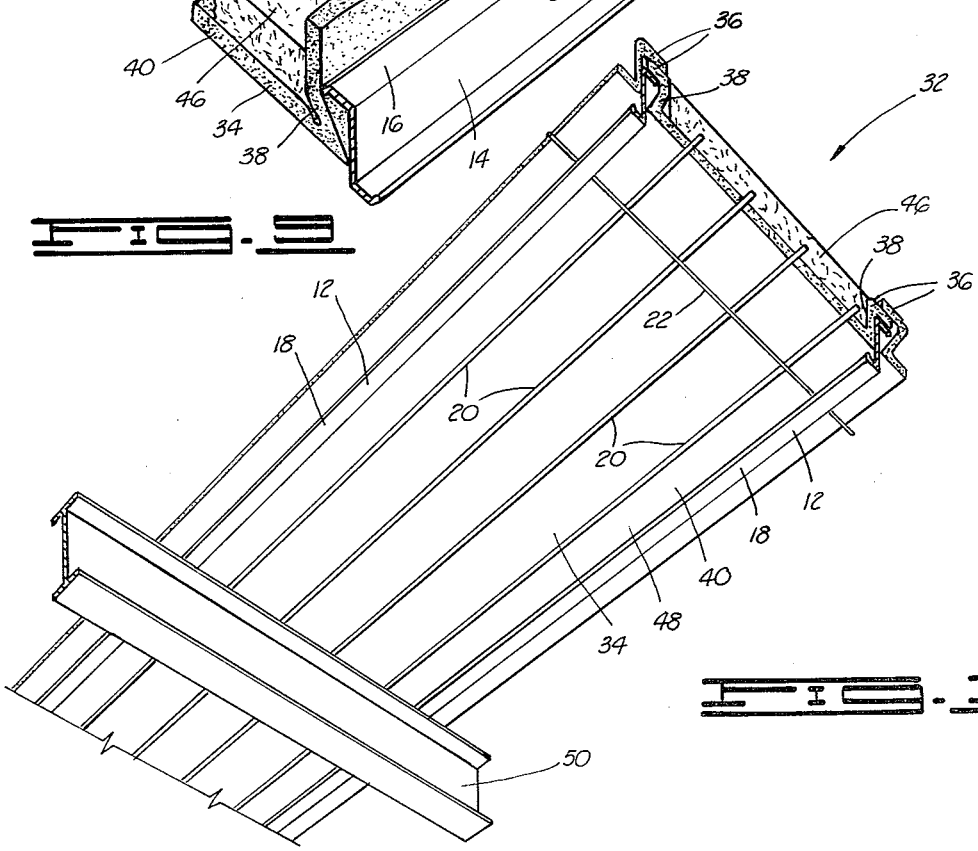
FIG. 10 is a perspective view looking upward toward the bottom of the metal roof and illustrating the roof purlins mounted on top of an I beam with the roof insulation structure installed on and between the roof purlins and resting on top of the insulation banding.

The self-supporting blanket 10 rests on top of longitudinal metal banding 20 and lateral banding 22. The lateral banding 22 is shown in FIG. 5 and FIG. 10. Depending on the thickness of the insulation blanket, the longitudinal banding 20 and lateral banding 20 will be adjusted along the height of the web 14 of the purlins 12.

Side portions 24 of the blanket 10 are received on top of the upper flanges 16 of the two purlins 12 with side portions 24 of adjacent blankets 10 overlapping and on top thereof. The two sides 24 of the adjacent blankets 10 are then compresssed on top of the upper flanges 16 by roof sheeting 26 shown in FIG. 9 and used to cover the top of the metal building roof.

From reviewing this cross sectional end view of the prior art insulated roof, it can be seen that a heat loss occurs in and around the top of the purlins 12 due to the necking down of the sides of the blankets 10 when they are attached to the top of the upper arms 16. Also the metal purlins 12, being subject to the heated interior of the building, act as heat sinks and dissipate the heat to the atmosphere in the neck-down area or decreased insulation area adjacent the upper arms 16.

Figure 2:
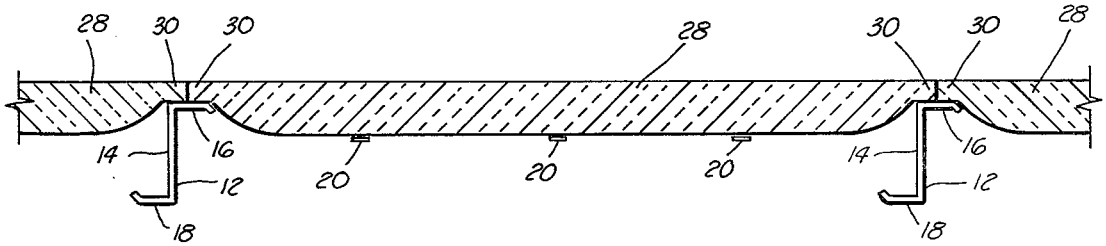
FIG. 2 PRIOR ART
FIG. 2 is a cross sectional end view of prior art construction using a low density thicker insulation blanket with the ends of the blanket in a butt joint with adjacent blankets of insulation.

In FIG. 2 an additional prior art roof insulation structure is illustrated wherein a thicker low density thermal insulation blanket 28 is used. The blanket 28 in this case can be in the range of three to four inches thick with side portions 30 in a butt joint relationship to the side portions 30 of the adjacent blankets 28. In this view it can be seen that the longitudinal banding 20 has been lowered when compared to the banding 20 shown in FIG. 1 so that the increased thicknesses of the blanket 28 can be accommodated. Again, heat loss is created by the neck-down area of the side portions 30 when they are secured to the top of the horizontal flanges 16 of the purlins 12.

Figure 3:
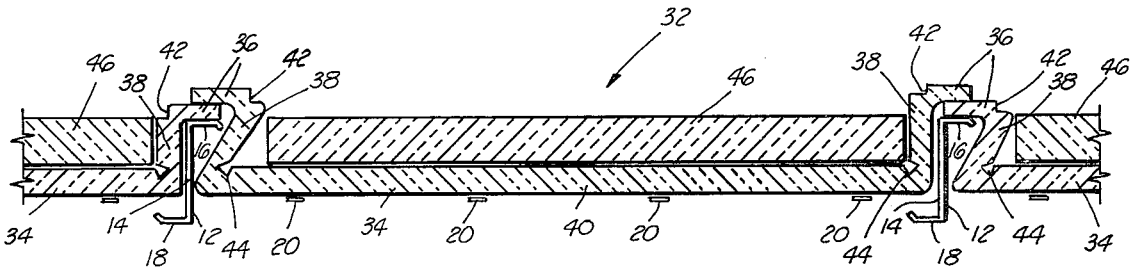
FIG. 3 is a cross sectional end view of the improved roof insulation structure illustrating the "U" shaped configuration of a self-supporting medium density thermal insulation blanket receiving a low density thick insulation blanket thereon.

In FIG. 3 the improved roof insulatiion structure of the subject invention is designated by general reference numeral 32. The improved structure 32 includes a self-supporting medium density thermal insulation blanket 34. The blanket 34 may be in the range of one to one and one-half inches thick. The blanket may also have dimensions less or greater than this range and still accomplish the purpose of the subject invention.

The blanket 34 has a "U" shaped configuration when viewed from end to end. The blanket 34 includes side portions 36 on the upper arms 16, intermediate portions 38 which are adjacent to the vertical web 14, and a center portion 40 which spans the width between the purlins 12. The side portions 36 are divided from the intermediate portions 38 by an elongated slit 42 which is cut in the top of the blanket 34 and along the length thereof. The intermediate portions 38 of the blanket 34 are divided from the center portion 40 by elongated notches 44 cut in top of the blanket 34 and along the length thereof.

By providing the "U" shaped configuration of the self-supporting blanket 34, the longitudinal banding 20 and lateral banding 22 can be lowered between the purlins 12 to accommodate a thick low density thermal insulation blanket 46. Depending on the "R" factor required, the blanket 46 can vary from five to seven inches thick or greater and still have sufficient space in the roof structure without the blanket 46 being compressed against the bottom of the metal sheeting 26 when it is secured to the upper flanges 16 of the purlins 12.

The side portions 36 of the blanket 34 are dimensioned so that they may be received on top of the upper arms 16 of the purlin 12 or as shown in FIG. 3, they are overlapped on top of side portions 36 of adjacent blankets 34. The slit 42 along the length of the blanket 34 allows the intermediate portions 38 to be folded into an obtuse angle or right angle with the side portions 36. The intermediate portions 38 are then tucked adjacent the sides of the web 14 of the purlins 12 for increasing the insulation on and around the purlins 12.

The notches 44 dividing the intermediate portions 38 from the center portion 40 of the blanket 34 allow the center portion 40 to be folded at an acute angle or right angle with the intermediate portions 38. Typically the width between the purlins 12 is in the range of 60 inches. This width may be more or less depending on the type of roof structure and the manufacturer used.

Figure 4:
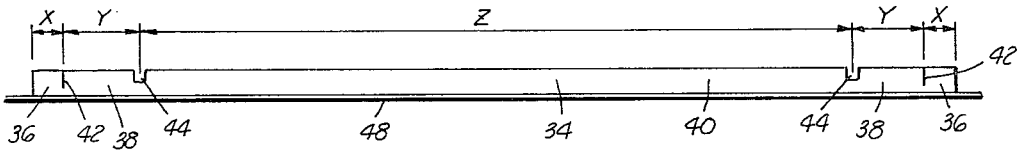
FIG. 4 is an end view of the self-supporting blanket with slits and notches cut therein prior to folding on and adjacent to the roof purlins.

In FIG. 4, an end view of the self-supporting blanket 34 is illustrated. In this view a vapor barrier sheet 48 is attached to the bottom of the blanket 34. The vapor barrier sheet may be made of vinyl or any other standard material used such as metal foil. Prior to folding and tucking the blanket 34 on and between the purlins 12, the slits 42 and notches 44 are cut into the top of the blanket 34. The slits 42 and notches 44 can generally be made during the laminating of the fiberglass insulation blanket 34 to the vapor barrier sheet 48. Typical dimension of a width X of the side portions 36 is in a range of two inches. A width Y of the intermediate portions 38 is in a range of six inches. An overall width Z of the center portion 40 is in a range of 56 to 58 inches. Again, these dimensions will vary depending on the types of purlins used and the width between the purlins. Also, the dimensions will vary depending on the thickness of the low density blanket 46 used.

Figure 6:
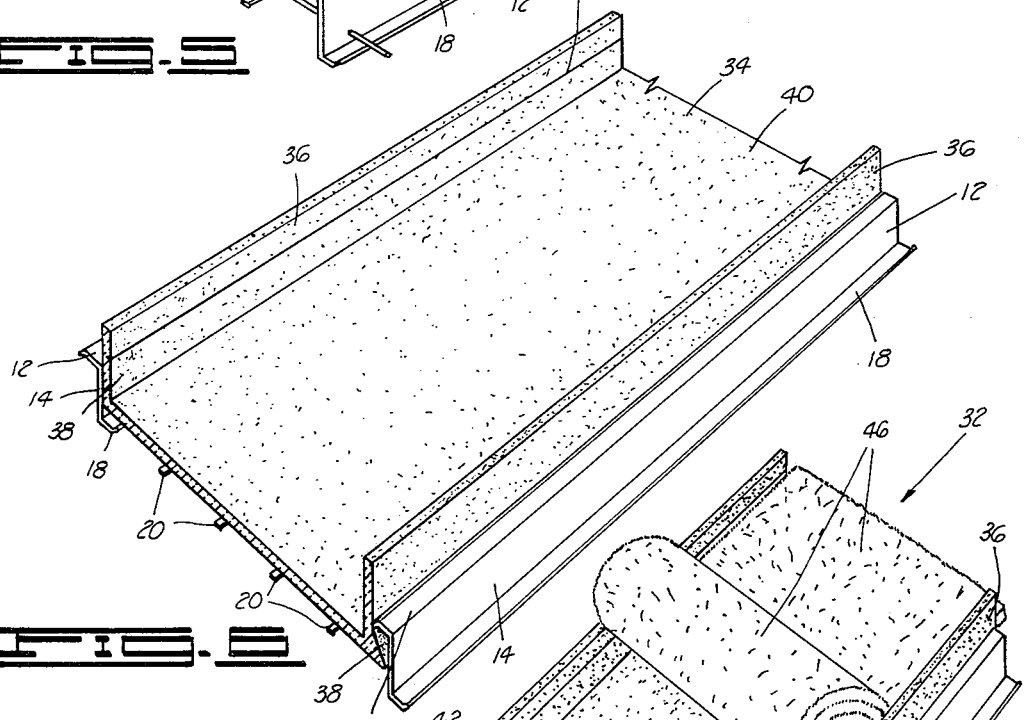
FIG. 6 illustrates the blanket unrolled and folded adjacent the webs of the roof purlins and received on top of the metal banding.
Figure 7:
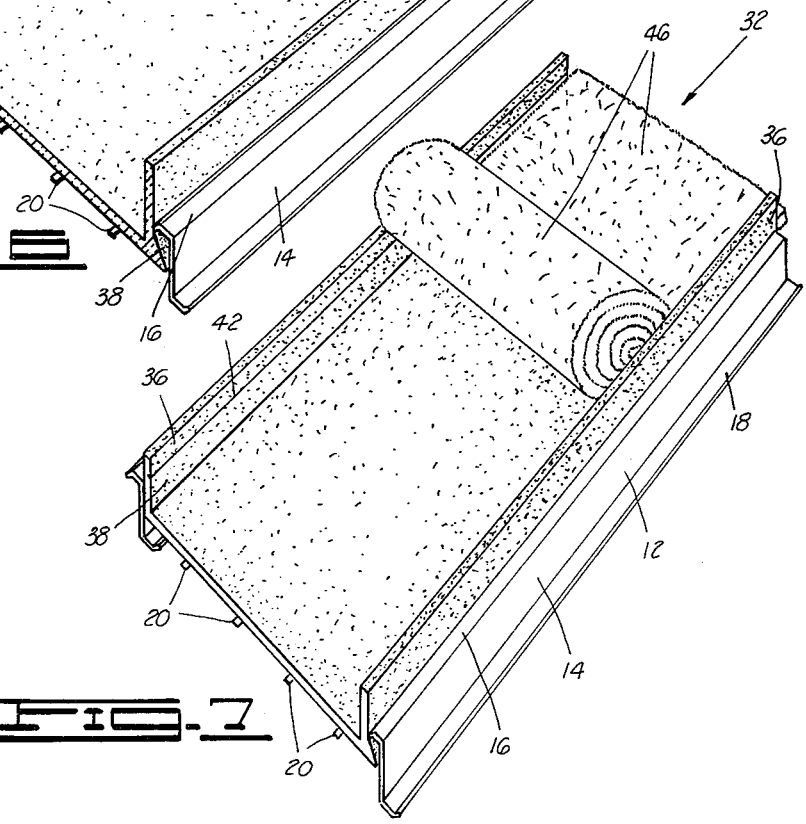
FIG. 7 illustrates a roll of the thick low density blanket being unrolled inside the "U" shaped configuration of the self-supporting blanket.

In referring to FIGS. 5, 6 and 7 the improved roof insulation structure 32 is illustrated on how it is applied on and between the metal roof purlins 12. As mentioned in the discussion of FIG. 4, the self-supporting blanket 34 is cut with slits 42 and notches 44 therein. The blanket 34 is then placed in a roll at one end of the purlins 12. The blanket 34 is then unrolled as shown in FIG. 6 with the intermediate portions 38 folded against the sides of the vertical webs 14 of the purlins 12 with the center portion 40 placed on top of the longitudinal and lateral banding 20 and 22. One of the advantages of the structure 34 is by the pre-slitting and notching of the semi-rigid blanket 34, it automatically provides a predetermined fold of the blanket 34 and self-aligns itself as it is folded and tucked adjacent the webs 14 of the purlins 12. This feature provides for reduced time and labor in installing roof insulation material.

Also seen in FIGS. 6 and 7 are the side portions 36 extending upwardly in a vertical position. In FIG. 7 a roll of the thick low density insulation blanket 46 is partially unrolled onto the top of the center portion 40 of the blanket 34 with the sides of the blanket 46 adjacent the intermediate portions 38 of the blanket 34.

Figure 8:
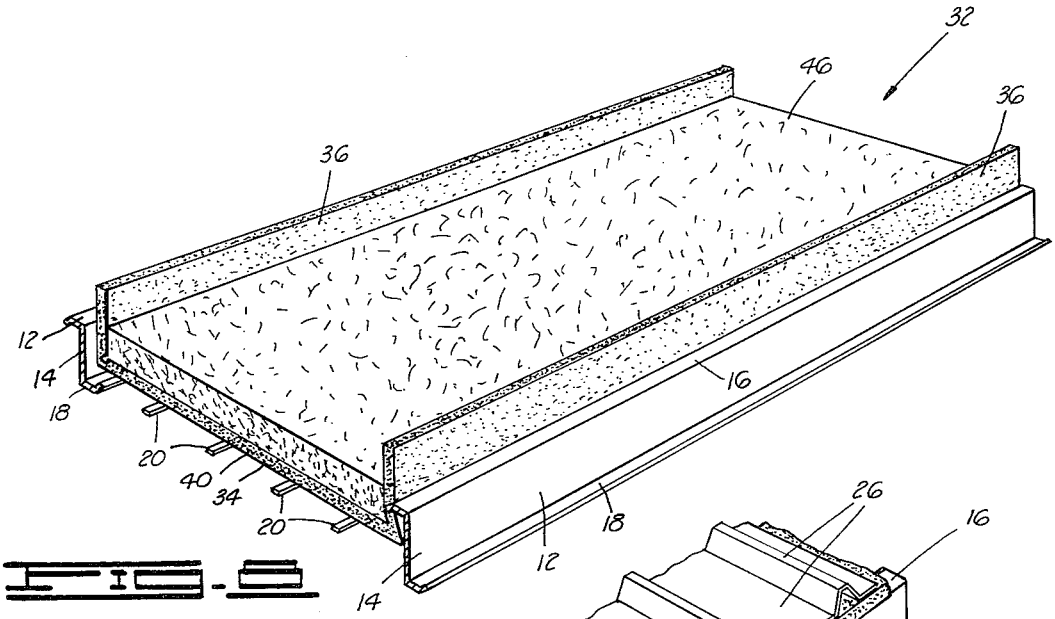
FIG. 8 illustrates the low density blanket completely unrolled on top of the self-supporting blanket.

In FIG. 8 the thick low density blanket 46 has been completely unrolled and received inside the "U" shaped configuration of the self-supporting blanket 34.

Figure 9:
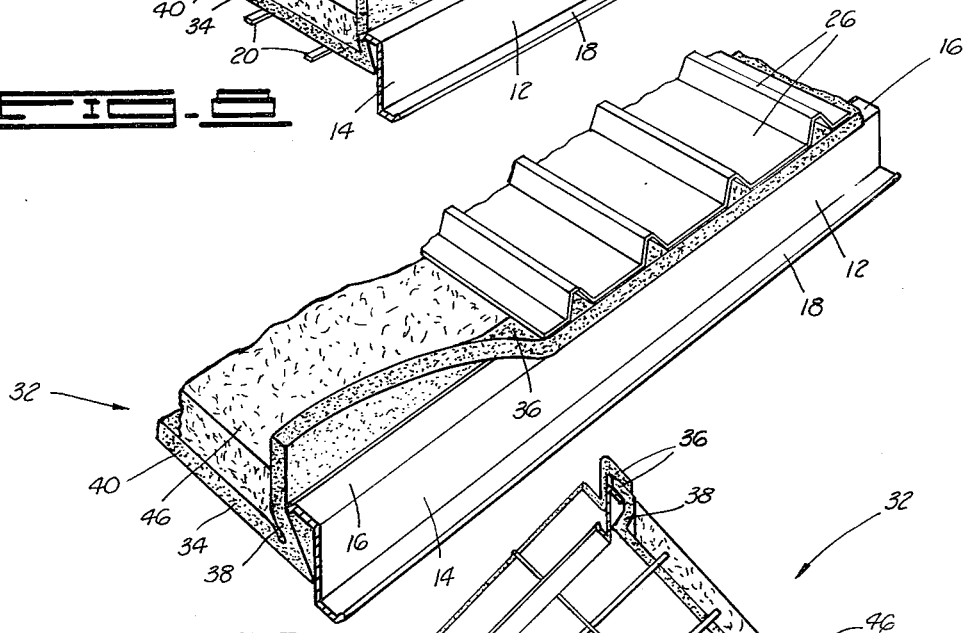
FIG. 9 illustrates the side portion of the self-supporting blanket folded on top of the upper flange of the roof purlin with metal roof sheeting being received on top of the roof purlin with the side portion of the self-supporting blanket received therebetween.

In FIG. 9 a partial perspective view of one of the purlins 12 is illustrated receiving the metal sheeting 26 on top of the upper flange 16 of the purlin 12. Prior to receiving the sheeting 26, the side portion 36 is folded into a horizontal position on top of the upper arm 16 where it is compressed between the sheeting 26 and the upper arm 16.

Again from reviewing the cross section of FIG. 3, it can be seen, depending on the location of the purlins 12, the side portions 36 will overlap one on top of the other prior to the sheeting 26 being attached to the top of the upper arm 16 of the purlin 12.

In FIG. 10, a perspective view of the roof structure is illustration viewing the bottom of the self-supporting insulation blanket 34 completely installed between the purlins 12 and on top of the longitudinal and lateral banding 20 and 22. In this view a building I beam 50 can be seen at right angles to the purlins 12 and supporting the purlins 12 thereon. Also seen in this view is an end view of the blanket 34 with the center portion 40 spanning the width between the purlins 12, the intermediate portions 38 are folded and tucked adjacent the web 14 of the purlins 12 with the side portions 36 of the blanket 34 overlapping and on top of the upper flanges 16 of the purlins 12. Also in a nesting relationship is the thick low density thermal insulation blanket 46 resting inside the "U" shaped configuration of the blanket 34.

From reading the above detailed description and viewing the drawings as described, it can be appreciated that through the use of a "U" shaped configuration of a self-supporting medium density insulation blanket disposed on top of, beside and between roof purlins, additional space is provided in a roof structure for receiving thicker insulation blankets. This type structure provides a roof insulating contractor with an increased area to add insulation thereby increasing the insulation "R" factor of the building and providing the owner of the building with overall reduced heating and cooling costs.

Changes may be made in the construction and arrangement of the parts or elements of the embodiments as described herein without departing from the spirit or scope of the invention defined in the following claims.

What is claimed is:

1. A roll of insulating material used for receipt on top of a roof and when unrolled received between a pair of adjacent and parallel metal roof purlins, the purlins having a vertical web and upper and lower horizontal flanges integrally formed into the top and bottom of the web and former a "Zee", "C", truss or bar joist type configuration, the insulating material comprising:

a blanket of self-supporting medium density thermal insulation, the blanket having from end to end a substantially "U" shaped configuration, the blanket including;

a pair of side portions opposite each other and adapted for receipt on top of the upper horizontal flanges of the adjacent purlins;

a pair of intermediate portions adapted for receipt adjacent the web of the purlins, the intermediate portions divided from the side portions by a pair of elongated slits cut in the top of the blanket and along the length thereof, the slits allowing the side portions of the blanket to be folded outwardly away from the slits and at an angle at least 90 degrees from the intermediate portions thereby allowing the side portions to be positioned on top of the upper horizontal flanges and the intermediate portions tucked adjacent the vertical web of the purlins; and a center portion adapted for spanning the width between the adjacent purlins, the center portion divided from the intermediate portions by a pair of elongated notches cut in the top of the blanket and along the length thereof, the notches allowing the intermediate portions of the blanket to be folded inwardly toward the notches and at an angle up to 90 degrees from the center portion;

the blanket adapted for receiving a thick blanket of low density thermal insulation inside the substantially "U" shaped configuration.

2. The insulating material as described in claim 1 further including a vapor barrier sheet attached to the bottom of the blanket.

3. The insulating material as described in claim 1 wherein the blanket is in a range of 1 to 2 inches thick and having a "R" factor in the range of 3–6.

4. The insulating material as described in claim 1 wherein one of the intermediate portions of the blanket is folded at an angle less than 90 degrees from the center portion with the other intermediate portion of the blanket folded at an angle of approximately 90 degrees from the center portion.

5. The insulating material as described in claim 1 wherein one of the side portions of the self-supporting blanket is folded at an angle greater than 90 degrees from its adjacent intermediate portion and the other side portion of the blanket folded at an angle approximately 90 degrees from its adjacent intermediate portion.

6. A roll of insulating material used for receipt on top of a roof and when unrolled received between a pair of adjacent and parallel metal roof purlins, the purlins having a vertical web and upper and lower horizontal flanges integrally formed into the top and bottom of the web forming a "Zee", "C", truss or bar joist type configuration, the insulating material comprising:

a blanket of self-supporting medium density thermal insulation, the blanket having from end to end a substantially "U" shaped configuration, the blanket including:

a pair of side portions opposite each other and adapted for receipt on top of the upper horizontal flanges of the adjacent purlins;

a pair of intermediate portions adpated for receipt adjacent the web of the purlins, the intermediate portions divided from the side portions by a pair of elongated slits cut in the top of the blanket and along the length thereof, the slits allowing one of the side portions of the blanket to be folded outwardly away from the slit at an angle greater than 90 degrees from its adjacent intermediate portion, the other side portion of the blanket folded outwardly from the slit at an angle of approximately 90 degrees from its adjacent intermediate portion, the slits allowing the side portions to be positioned on top of the upper horizontal flanges and the intermediate portions tucked adjacent the vertical web of the purlins; and a horizontal center portion adapted for spanning the width between the adjacent purlins, the center portions divided from the intermediate portions by a pair of elongated notches cut in the top of the blanket and along the length thereof, the notches allowing one of the intermediate portions of the blanket to be folded inwardly toward the notch at an angle less than 90 degrees from the center portion with the other intermediate portion folded inwardly toward the notch at an angle approximately 90 degrees from the center portion;

the blanket adapted for receiving a thick blanket of low density thermal insulation inside the substantially "U" shaped configuration.

7. A method of insulating the top of a roof having a pair of adjacent and parallel roof purlins, the purlins having a vertical web and upper and lower horizontal flanges integrally formed into the top and bottom of the web forming a "Zee", "C", truss or bar joinst type configuration, the steps comprising:

forming a pair of elongated notches in the top of a blanket of self-supporting medium density thermal insulation and along the length thereof and forming a center portion of the blanket therebetween;

forming a pair of elongated slits in the top of the blanket and along the length thereof, the slits spaced apart a greater distance than the notches and forming intermediate portions of the blanket therebetween and side portions between the slits and the edges of the length of the blanket;

rolling the blanket into a roll for transportation to and onto the roof;

unrolling the blanket on top of and between the adjacent purlins;

folding inwardly the intermediate portion of the blanket at an angle up to 90 degrees from the center portion with the center portion spanning the width between the adjacent purlins and the intermediate portions tucked adjacent the vertical web of the purlins; and folding outwardly away from the slits the side portions of the blanket at an angle at least 90 degrees from the intermediate portions thereby allowing the side portions to be positioned on top of the upper horizontal flanges.

8. The method as described in claim 7 further including the step of unrolling a thick blanket of low density thermal insulation inside the substantially "U" shaped configuration formed by the blanket and between the purlins.

9. The method as described in claim 7 wherein one of the side portions of the blanket is folded at an angle greater than 90 degrees from its adjacent intermediate portion and the other side portion of the blanket is folded at an angle approximately 90 degrees from its adjacent intermediate portion.

10. The method as described in claim 7 wherein one of the intermediate portions of the blanket is folded at an angle less than 90 degrees from the center portion with the other intermediate portion of the blanket folded at an angle of approximately 90 degrees from the center portion.

* * * * *